US005726648A

United States Patent [19]

Soon

[11] Patent Number: 5,726,648

[45] Date of Patent: Mar. 10, 1998

[54] TIME INDICATING TRAFFIC LIGHT

[76] Inventor: Min Tet Soon, P.O. Box 10341,88803, Kota Kinabalu, Sabah, Malaysia

[21] Appl. No.: 766,186

[22] Filed: Dec. 12, 1996

[51] Int. Cl.[6] ..... G08G 1/096

[52] U.S. Cl. ..... 340/929; 340/930; 340/907

[58] Field of Search ..... 340/907, 925, 340/929, 930, 944

[56] References Cited

U.S. PATENT DOCUMENTS

| | | | |
|---|---|---|---|
| 2,480,290 | 8/1949 | Fein | 340/929 |
| 2,842,627 | 7/1958 | Wagner | 340/929 |
| 3,320,585 | 5/1967 | Hines | 340/929 |
| 3,408,623 | 10/1968 | Wagner | 340/929 |
| 3,480,909 | 11/1969 | Hines | 340/929 |
| 4,255,737 | 3/1981 | Casteel | 340/930 |
| 4,590,455 | 5/1986 | Fritzinger | 340/907 |
| 5,294,924 | 3/1994 | Dydzyk | 340/908.1 |

FOREIGN PATENT DOCUMENTS

| | | | |
|---|---|---|---|
| 2691566 | 5/1992 | France | 340/929 |

*Primary Examiner*—Brent A. Swarthout
*Assistant Examiner*—Van T. Trieu
*Attorney, Agent, or Firm*—Richard L. Miller, P.E.

[57] ABSTRACT

A time indicating traffic light that includes a vertically-oriented and rectangular-parallelepiped-shaped housing, a circular-shaped "stop" indicator light, a circular-shaped "caution" indicator light, seven rectangular-shaped "go" indicator lights, and a time indicating display. The circular-shaped "stop" indicator light, the circular-shaped "caution" indicator light, and the seven rectangular-shaped "go" indicator lights are disposed in the vertically-oriented and rectangular-parallelepiped-shaped housing. The seven rectangular-shaped "go" indicator lights have a pair of parallel, elongated, spaced-apart, vertically-oriented, and rectangular-shaped "go" indicator lights, and five adjacent, slightly vertically spaced-apart, horizontally-oriented, and rectangular-shaped "go" lights. The five adjacent, slightly vertically spaced-apart, horizontally-oriented, and rectangular-shaped "go" lights extinguish progressively upwardly towards the circular-shaped "caution" indicator light at a predetermined rate determined by a timer while the pair of parallel, elongated, spaced-apart, vertically-oriented, and rectangular-shaped "go" indicator lights remain illuminated when at least one light of the five adjacent, slightly vertically spaced-apart, horizontally-oriented, and rectangular-shaped "go" lights is illuminated. The time indicating display is disposed on the vertically-oriented and rectangular-parallelepiped-shaped housing and provides a visible display of the time of illumination of the seven rectangular-shaped "go" indicator lights, so that an approaching vehicle can determine when the circular-shaped "caution" indicator light will be illuminated by dividing the time of illumination on the time indicating display by the number of lights of the five adjacent, slightly vertically spaced-apart, horizontally-oriented, and rectangular-shaped "go" lights extinguished and thereby prevent sudden acceleration followed by a sudden stop.

25 Claims, 2 Drawing Sheets

TIME INDICATING TRAFFIC LIGHT

BACKGROUND OF THE INVENTION

The present invention relates to a time indicating traffic light. More particularly, the present invention relates to a time indicating traffic light that includes a vertically-oriented and rectangular-parallelepiped-shaped housing, a circular-shaped "stop" indicator light disposed in a circular-shaped throughbore in an upper portion of a horizontal front of the vertically-oriented and rectangular-parallelepiped-shaped housing, a circular-shaped "caution" indicator light disposed in a circular-shaped throughbore in an upper intermediate portion of the horizontal front of the vertically-oriented and rectangular-parallelepiped-shaped housing, seven rectangular-shaped "go" indicator lights disposed in seven rectangular-shaped throughbores in a lower intermediate portion of the horizontal front of the vertically-oriented and rectangular-parallelepiped-shaped housing, and a time indicating display disposed on a lower portion of the horizontal front of the vertically-oriented and rectangular-parallelepiped-shaped housing.

Numerous traffic signal devices have been proposed in the past. One type of such device includes a housing having four walls with lights disposed in each of the walls. A centrally located rotating element sequentially illuminates the appropriate light for controlling traffic flow.

Additionally, some of the proposed traffic signals include light change indicators, such as those including a gas tube signalling element that has extensions which are illuminated in fractional parts, addivitely, or subtractively, to visibly indicate the time remaining between differing illumination patterns of the traffic signal. Another type includes rotating shutters that have arcuately shaped slots disposed over opposed warning tubes to progressively cover and uncover the warning tubes and thereby indicating the time left before the light changes.

Numerous innovations for traffic light systems have been provided in the prior art that will be described. Even though these innovations may be suitable for the specific individual purposes to which they address, however, they differ from the present invention in that they do not teach a time indicating traffic light that includes a vertically-oriented and rectangular-parallelepiped-shaped housing, a circular-shaped "stop" indicator light disposed in a circular-shaped throughbore in an upper portion of a horizontal front of the vertically-oriented and rectangular-parallelepiped-shaped housing, a circular-shaped "caution" indicator light disposed in a circular-shaped throughbore in an upper intermediate portion of the horizontal front of the vertically-oriented and rectangular-parallelepiped-shaped housing, seven rectangular-shaped "go" indicator lights disposed in seven rectangular-shaped throughbores in a lower intermediate portion of the horizontal front of the vertically-oriented and rectangular-parallelepiped-shaped housing, and a time indicating display disposed on a lower portion of the horizontal front of the vertically-oriented and rectangular-parallelepiped-shaped housing.

FOR EXAMPLE, U.S. Pat. No. 3,480,909 to Hines teaches a plural direction traffic signalling assembly that has three different signal lamps for each direction and time countdown display means. A controller governs the operation of the signalling assembly and the countdown display means. A lamp control section has a plurality of switching devices that are respectively connected to each of the signal lamps and render the same operative and inoperative. Control gate means is operatively connected to the switching devices and externally controls the operation of two of the signal lamps for each direction. Means interconnect the switching devices and the control gate means and internally controls operation of the third signal lamp for each direction in a predetermined sequence with the two signal lamps. A timing section is connected to the control gate means of the lamp control section and supplies timed signal pulses to sequentially operate the switching devices during a timing cycle. Logic circuit means connects the timing section to the display means and displays timing information during a portion of the timing cycle when one of the two externally controlled signal lamps is operative.

ANOTHER EXAMPLE, U.S. Pat. No. 4,255,737 to Casteel teaches a traffic signal that has a four sided housing. Each side of which contains red and green areas which can be illuminated. Furthermore, each side contains a rotating semicircular mask which simultaneously and progressively covers one portion of one of the colored areas and uncovers a portion of the other colored area until the illumination of the traffic light is changed thereby causing a change in traffic flow. The rotation of the masks together with the actuation of the various lights is controlled from a common ring gear disposed within the housing and driven by a single motor.

STILL ANOTHER EXAMPLE, U.S. Pat. No. 4,590,455 to Fritzinger teaches a traffic control system that has green and/or red signal lights blinked momentarily at a predetermined interval before the direction of traffic is changed. A marker is placed along the roadway at a normal distance of travel within the timing of the blink signal to enable motorists to gauge their driving to save gasoline and achieve greater safety solely by noting their location relative to the marker when the blink signal occurs. Further taught is the use of the traffic signalling system in connection with a semi-actuated controller that has a synchronizer providing a background cycle. The timing of the blink signal and the yellow caution signal is obtained from the synchronizer.

FINALLY, YET ANOTHER EXAMPLE, U.S. Pat. No. 5,294,924 to Dydzyk teaches a compact, ambient light sensitive flashing warning light that is removably attached to a traffic control device to alert on-coming motorists and pedestrians of a roadway condition. A photocell is connected between a light bulb and a battery voltage source, so that illumination of the bulb can be made dependent upon ambient light conditions. The warning light includes a tapered attachment leg that is sized to fit through a hole in the top of a conventional hollow traffic cone, such that the warning light is removably attached to the cone by friction. As an alternate embodiment, the warning light may be interfaced with a bracket that is adapted to be fastened to other traffic control devices such as a conventional wooden barricade.

It is apparent that numerous innovations for traffic light systems have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a time indicating traffic light that avoids the disadvantages of the prior art.

ANOTHER OBJECT of the present invention is to provide a time indicating traffic light that is simple and inexpensive to manufacture.

STILL ANOTHER OBJECT of the present invention is to provide a time indicating traffic light that is simple to use.

YET ANOTHER OBJECT of the present invention is to provide a time indicating traffic light that alerts the road users of how long the traffic light will remain green and how much time is left.

STILL YET ANOTHER OBJECT of the present invention is to provide a time indicating traffic light that allows a road user approaching from a far distance, especially say 200 feet, to make a determination of whether to accelerate or slow down.

YET STILL ANOTHER OBJECT of the present invention is to provide a time indicating traffic light that prevents a road user from having to accelerate and then suddenly stop.

STILL YET ANOTHER OBJECT of the present invention is to provide a time indicating traffic light that prevents pile up accidents, especially from the rear, when there is a short time remaining on the green signal.

YET STILL ANOTHER OBJECT of the present invention is to provide a time indicating traffic light that fosters the smooth flow of traffic by eliminating the necessity of slowing down, especially when there is a long time remaining on the green signal.

STILL YET ANOTHER OBJECT of the present invention is to provide a time indicating traffic light that is user friendly.

BRIEFLY STATED, YET STILL ANOTHER OBJECT of the present invention is to provide a time indicating traffic light that includes a vertically-oriented and rectangular-parallelepiped-shaped housing, a circular-shaped "stop" indicator light, a circular-shaped "caution" indicator light, seven rectangular-shaped "go" indicator lights, and a time indicating display.

STILL YET ANOTHER OBJECT of the present invention is to provide a time indicating traffic light wherein the circular-shaped "stop" indicator light is disposed in the vertically-oriented and rectangular-parallelepiped-shaped housing.

YET STILL ANOTHER OBJECT of the present invention is to provide a time indicating traffic light wherein the circular-shaped "caution" indicator light is disposed in the vertically-oriented and rectangular-parallelepiped-shaped housing below the circular-shaped "stop" indicator light.

STILL YET ANOTHER OBJECT of the present invention is to provide a time indicating traffic light wherein the seven rectangular-shaped "go" indicator lights are disposed in the vertically-oriented and rectangular-parallelepiped-shaped housing below the circular-shaped "caution" indicator light and have a time of illumination, a pair of parallel, elongated, spaced-apart, vertically-oriented, and rectangular-shaped "go" indicator lights, and five adjacent, slightly vertically spaced-apart, horizontally-oriented, and rectangular-shaped "go" lights disposed between the pair of parallel, elongated, spaced-apart, vertically-oriented, and rectangular-shaped "go" indicator lights of the seven rectangular-shaped "go" indicator lights.

YET STILL ANOTHER OBJECT of the present invention is to provide a time indicating traffic light wherein the five adjacent, slightly vertically spaced-apart, horizontally-oriented, and rectangular-shaped "go" lights of the seven rectangular-shaped "go" indicator lights extinguish progressively upwardly towards the circular-shaped "caution" indicator light at a predetermined rate determined by a timer while the pair of parallel, elongated, spaced-apart, vertically-oriented, and rectangular-shaped "go" indicator lights of the seven rectangular-shaped "go" indicator lights remain illuminated when at least one light of the five adjacent, slightly vertically spaced-apart, horizontally-oriented, and rectangular-shaped "go" lights of the seven rectangular-shaped "go" indicator lights is illuminated.

STILL YET ANOTHER OBJECT of the present invention is to provide a time indicating traffic light wherein the time indicating display is disposed on the vertically-oriented and rectangular-parallelepiped-shaped housing below the seven rectangular-shaped "go" indicator lights and provides a visible display of the time of illumination of the seven rectangular-shaped "go" indicator lights, so that an approaching vehicle can determine when the circular-shaped "caution" indicator light will be illuminated by dividing the time of illumination on the time indicating display by number of lights of the five adjacent, slightly vertically spaced-apart, horizontally-oriented, and rectangular-shaped "go" lights of the seven rectangular-shaped "go" indicator lights extinguished and thereby prevent sudden acceleration followed by a sudden stop while the pair of parallel, elongated, spaced-apart, vertically-oriented, and rectangular-shaped "go" indicator lights of the seven rectangular-shaped "go" indicator lights provide a means of determining when the circular-shaped "caution" indicator light will be illuminated when the time indicating display may not be easily seen such as when the approaching vehicle is at a far distance by providing a visual comparison of light emanating therefrom with light emanating from whatever lights of the five adjacent, slightly vertically spaced-apart, horizontally-oriented, and rectangular-shaped "go" lights of the seven rectangular-shaped "go" indicator lights are illuminated.

YET STILL ANOTHER OBJECT of the present invention is to provide a time indicating traffic light wherein the circular-shaped "stop" indicator light is red since red is the international signal for "stop."

STILL YET ANOTHER OBJECT of the present invention is to provide a time indicating traffic light wherein the circular-shaped "caution" indicator light is amber since amber is the international signal for "caution."

YET STILL ANOTHER OBJECT of the present invention is to provide a time indicating traffic light wherein the seven rectangular-shaped "go" indicator lights are green since green is the international signal for "go."

STILL YET ANOTHER OBJECT of the present invention is to provide a time indicating traffic light that further includes a vertically-oriented, slender, and rectangular-shaped turn signal plate that has an inner longitudinal edge with five, adjacent, slightly vertically spaced-apart, and outwardly converging V-shaped grooves therealong and is positionable over either side of the five adjacent, slightly vertically spaced-apart, horizontally-oriented, and rectangular-shaped "go" lights of the seven rectangular-shaped "go" indicator lights with each groove of the five, adjacent, slightly vertically spaced-apart, and outwardly converging V-shaped grooves in the inner longitudinal edge of the vertically-oriented, slender, and rectangular-shaped turn signal plate being aligned with a respective light of the five adjacent, slightly vertically spaced-apart, horizontally-oriented, and rectangular-shaped "go" lights of the seven rectangular-shaped "go" indicator lights, so that the five adjacent, slightly vertically spaced-apart, horizontally-oriented, and rectangular-shaped "go" lights of the seven rectangular-shaped "go" indicator lights have a respective set of pointed sides and can be used as turn signal indicators, if so desired.

YET STILL ANOTHER OBJECT of the present invention is to provide a time indicating traffic light wherein the vertically-oriented and rectangular-parallelepiped-shaped housing has a rectangular-shaped front with an upper portion, an upper intermediate portion disposed below the upper portion of the rectangular-shaped front of the vertically-oriented and rectangular-parallelepiped-shaped housing, a lower intermediate portion disposed below the upper intermediate portion of the rectangular-shaped front of the vertically-oriented and rectangular-parallelepiped-shaped housing, and a lower portion that has an upper boundary and a lower boundary and is disposed below the lower intermediate portion of the rectangular-shaped front of the vertically-oriented and rectangular-parallelepiped-shaped housing.

STILL YET ANOTHER OBJECT of the present invention is to provide a time indicating traffic light wherein the upper portion of the rectangular-shaped front of the vertically-oriented and rectangular-parallelepiped-shaped housing has a circular-shaped throughbore that extends horizontally therethrough.

YET STILL ANOTHER OBJECT of the present invention is to provide a time indicating traffic light wherein the circular-shaped "stop" indicator light has an upper periphery and occupies the circular-shaped throughbore in the upper portion of the rectangular-shaped front of the vertically-oriented and rectangular-parallelepiped-shaped housing.

STILL YET ANOTHER OBJECT of the present invention is to provide a time indicating traffic light that further includes a substantially semi-cylindrically-shaped "stop" light visor that extends outwardly from the upper periphery of the circular-shaped "stop" indicator light.

YET STILL ANOTHER OBJECT of the present invention is to provide a time indicating traffic light wherein the upper intermediate portion of the rectangular-shaped front of the vertically-oriented and rectangular-parallelepiped-shaped housing has a circular-shaped throughbore that extends horizontally therethrough.

STILL YET ANOTHER OBJECT of the present invention is to provide a time indicating traffic light wherein the circular-shaped "caution" indicator light has an upper periphery and occupies the circular-shaped throughbore in the upper intermediate portion of the rectangular-shaped front of the vertically-oriented and rectangular-parallelepiped-shaped housing.

YET STILL ANOTHER OBJECT of the present invention is to provide a time indicating traffic light that further includes a substantially semi-cylindrically-shaped "caution" light visor extending outwardly from the upper periphery of the circular-shaped "caution" indicator light.

STILL YET ANOTHER OBJECT of the present invention is to provide a time indicating traffic light wherein the lower intermediate portion of the rectangular-shaped front of the vertically-oriented and rectangular-parallelepiped-shaped housing has five adjacent, slightly vertically spaced-apart, horizontally-oriented, and rectangular-shaped throughbores that extend horizontally therethrough and have a combined height.

YET STILL ANOTHER OBJECT of the present invention is to provide a time indicating traffic light wherein the lower intermediate portion of the rectangular-shaped front of the vertically-oriented and rectangular-parallelepiped-shaped housing further has a pair of parallel, elongated, spaced-apart, vertically-oriented, and rectangular-shaped throughbores that extend horizontally therethrough.

STILL YET ANOTHER OBJECT of the present invention is to provide a time indicating traffic light wherein one throughbore of the pair of parallel, elongated, spaced-apart, vertically-oriented, and rectangular-shaped throughbores in the lower intermediate portion of the rectangular-shaped front of the vertically-oriented and rectangular-parallelepiped-shaped housing is disposed parallel to, and slightly to one side of, the five adjacent, slightly vertically spaced-apart, horizontally-oriented, and rectangular-shaped throughbores in the lower intermediate portion of the rectangular-shaped front of the vertically-oriented and rectangular-parallelepiped-shaped housing and extends the combined height thereof.

YET STILL ANOTHER OBJECT of the present invention is to provide a time indicating traffic light wherein another throughbore of the pair of parallel, elongated, spaced-apart, vertically-oriented, and rectangular-shaped throughbores in the lower intermediate portion of the rectangular-shaped front of the vertically-oriented and rectangular-parallelepiped-shaped housing is disposed parallel to, and slightly to an opposite side of, the five adjacent, slightly vertically spaced-apart horizontally-oriented, and rectangular-shaped throughbores in the lower intermediate portion of the rectangular-shaped front of the vertically-oriented and rectangular-parallelepiped-shaped housing and extends the combined height thereof.

STILL YET ANOTHER OBJECT of the present invention is to provide a time indicating traffic light wherein the seven rectangular-shaped "go" indicator lights have an uppermost horizontal edge and a pair of outermost vertical edges.

YET STILL ANOTHER OBJECT of the present invention is to provide a time indicating traffic light wherein each light of the five adjacent, slightly vertically spaced-apart, horizontally-oriented, and rectangular-shaped "go" lights of the seven rectangular-shaped "go" indicator lights occupies a respective throughbore of the five adjacent, slightly vertically spaced-apart, horizontally-oriented, and rectangular-shaped throughbores in the lower intermediate portion of the rectangular-shaped front of the vertically-oriented and rectangular-parallelepiped-shaped housing.

STILL YET ANOTHER OBJECT of the present invention is to provide a time indicating traffic light wherein each light of the pair of parallel, elongated, spaced-apart, vertically-oriented, and rectangular-shaped "go" indicator lights of the seven rectangular-shaped "go" indicator lights occupies a respective throughbore of the pair of parallel, elongated, spaced-apart, vertically-oriented, and rectangular-shaped throughbores in the lower intermediate portion of the rectangular-shaped front of the vertically-oriented and rectangular-parallelepiped-shaped housing.

YET STILL ANOTHER OBJECT of the present invention is to provide a time indicating traffic light that further includes a inverted substantially U-shaped "go" light visor that extends outwardly from the uppermost horizontal edge and the pair of outermost vertical edges of the seven rectangular-shaped "go" indicator lights.

STILL YET ANOTHER OBJECT of the present invention is to provide a time indicating traffic light wherein the time indicating display is disposed on the lower portion of the rectangular-shaped front of the vertically-oriented and rectangular-parallelepiped-shaped housing and includes a pair of horizontally-oriented, parallel, vertically spaced-apart, and L-shaped slide tracks.

YET STILL ANOTHER OBJECT of the present invention is to provide a time indicating traffic light wherein one track of the pair of horizontally-oriented, parallel, vertically spaced-apart, and L-shaped slide tracks of the time indicating display is disposed horizontally, and in proximity to, the upper boundary of the lower portion of the rectangular-shaped front of the vertically-oriented and rectangular-parallelepiped-shaped housing.

STILL YET ANOTHER OBJECT of the present invention is to provide a time indicating traffic light wherein another track of the pair of horizontally-oriented, parallel, vertically spaced-apart, and L-shaped slide tracks of the time indicating display is disposed horizontally, and in proximity to, the lower boundary of the lower portion of the rectangular-shaped front of the vertically-oriented and rectangular-parallelepiped-shaped housing.

YET STILL ANOTHER OBJECT of the present invention is to provide a time indicating traffic light wherein the time indicating display further includes a pair of generally rectangular-shaped digital plates that are slidably and replaceably mounted in the pair of horizontally-oriented, parallel, vertically spaced-apart, and L-shaped slide tracks of the time indicating display.

STILL YET ANOTHER OBJECT of the present invention is to provide a time indicating traffic light wherein each plate of the pair of generally rectangular-shaped digital plates of the time indicating display has disposed thereon a light reflective integer in a range of "0" to "9", so that by using the pair of generally rectangular-shaped digital plates of the time indicating display with appropriate light reflective integers of the time indicating display disposed thereon, visible means is provided to the approaching vehicle of how much time all of the seven rectangular-shaped "go" indicator lights will be illuminated.

YET STILL ANOTHER OBJECT of the present invention is to provide a time indicating traffic light wherein the pair of horizontally-oriented, parallel, vertically spaced-apart, and L-shaped slide tracks of the time indicating display has a pair of corresponding ends with stops, so that the pair of generally rectangular-shaped digital plates of the time indicating display are prevented from unintentionally sliding out of the pair of corresponding ends of the pair of horizontally-oriented, parallel, vertically spaced-apart, and L-shaped slide tracks of the time indicating display.

STILL YET ANOTHER OBJECT of the present invention is to provide a time indicating traffic light wherein the time indicating display further includes a vertically-oriented, and L-shaped slide track that extends between another pair of corresponding ends of the pair of horizontally-oriented, parallel, vertically spaced-apart, and L-shaped slide tracks of the time indicating display and is replaceably maintained to the lower portion of the rectangular-shaped front of the vertically-oriented and rectangular-parallelepiped-shaped housing by a lock screw that passes replaceably through a throughbore therein and into a throughbore in the lower portion of the rectangular-shaped front of the vertically-oriented and rectangular-parallelepiped-shaped housing, so that the pair of generally rectangular-shaped digital plates of the time indicating display are prevented from unintentionally sliding out of the another pair of corresponding ends of the pair of horizontally-oriented, parallel, vertically spaced-apart, and L-shaped slide tracks of the time indicating display.

FINALLY, YET STILL ANOTHER OBJECT of the present invention is to provide a method of utilizing a time indicating traffic light to alert an approaching vehicle when a circular-shaped "caution" indicator light will be illuminated that includes the steps of extinguishing a circular-shaped "stop" indicator light that occupies a circular-shaped throughbore in an upper portion of a horizontally-shaped front of a rectangular-parallelepiped-shaped housing of the time indicating traffic light; extinguishing the circular-shaped "caution" indicator light that occupies a circular-shaped throughbore in an upper intermediate portion of the horizontally-shaped front of the rectangular-parallelepiped-shaped housing which is below the upper portion of the horizontally-shaped front of the rectangular-parallelepiped-shaped housing; illuminating five adjacent, slightly vertically spaced-apart, horizontally-oriented, and rectangular-shaped "go" lights of seven rectangular-shaped "go" indicator lights of the time indicating traffic signal that have a combined height and wherein each of which occupies a respective throughbore of five adjacent, slightly vertically spaced-apart, horizontally-oriented, and rectangular-shaped throughbores in a lower intermediate portion of the horizontally-shaped front of the rectangular-parallelepiped-shaped housing which is below the upper intermediate portion of the horizontally-shaped front of the rectangular-parallelepiped-shaped housing; illuminating simultaneously a pair of parallel, elongated, spaced-apart, vertically-oriented, and rectangular-shaped "go" indicator lights of the seven rectangular-shaped "go" indicator light and wherein each of which occupies a respective throughbore of a pair of elongated, spaced-apart, vertically-oriented, and rectangular-shaped throughbores that are spaced slightly from each side of, and extend the combined height of, the five adjacent, slightly vertically spaced-apart, horizontally-oriented, and rectangular-shaped "go" lights of the seven rectangular-shaped "go" indicator lights; visually inspecting by the approaching vehicle a time indicating display device disposed on a lower portion of the horizontally-shaped front of the rectangular-parallelepiped-shaped housing which is below the lower intermediate portion of the horizontally-shaped front of the rectangular-parallelepiped-shaped housing and which provides a visible display of time of illumination of all of the seven rectangular-shaped "go" indicator lights; extinguishing a lowermost light of the five adjacent, slightly vertically spaced-apart, horizontally-oriented, and rectangular-shaped "go" lights of the seven rectangular-shaped "go" indicator lights after a predetermined time determined by a timer has elapsed; indicating to the approaching vehicle that only 4/5 of the time of illumination of all of the seven rectangular-shaped "go" indicator lights indicated on the time indicating display remains before the circular-shaped "caution" indicator light is illuminated; extinguishing a next higher light of the five adjacent, slightly vertically spaced-apart, horizontally-oriented, and rectangular-shaped "go" lights of the seven rectangular-shaped "go" indicator lights after the predetermined time determined by the timer has elapsed; indicating to the approaching vehicle that only 3/5 of the time of illumination of all of the seven rectangular-shaped "go" indicator lights indicated on the time indicating display remains before the circular-shaped "caution" indicator light is illuminated; extinguishing a next higher light of the five adjacent, slightly vertically spaced-apart, horizontally-oriented, and rectangular-shaped "go" lights of the seven rectangular-shaped "go" indicator lights after the predetermined time determined by the timer has elapsed; indicating to the approaching vehicle that only 2/5 of the time of illumination of all of the seven rectangular-shaped "go" indicator lights indicated on the time indicating display remains before the circular-shaped "caution" indicator light is illuminated; extinguishing a next higher light of the five adjacent, slightly vertically spaced-apart, horizontally-oriented, and rectangular-shaped "go" lights of the seven rectangular-shaped "go" indicator lights after the predetermined time determined by the timer has elapsed; indicating to the approaching vehicle that only 1/5 of the time of illumination of all of the seven rectangular-shaped "go" indicator lights indicated on the time indicating display remains before the circular-shaped "caution" indicator light is illuminated; extinguishing a highest light of the five adjacent, slightly vertically spaced-apart, horizontally-oriented, and rectangular-shaped "go" lights of the seven rectangular-shaped "go" indicator lights after the predetermined time determined by the timer has elapsed; extinguishing simultaneously the pair of parallel, elongated, spaced-apart, vertically-oriented, and rectangular-shaped "go" indicator lights of the seven rectangular-shaped "go" indicator lights; and indicating to the approaching vehicle that no time remains before the circular-shaped "caution" indicator light is illuminated, so that the approaching vehicle is alerted that the circular-shaped "caution" indicator light will be illuminated.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

Figure 1:
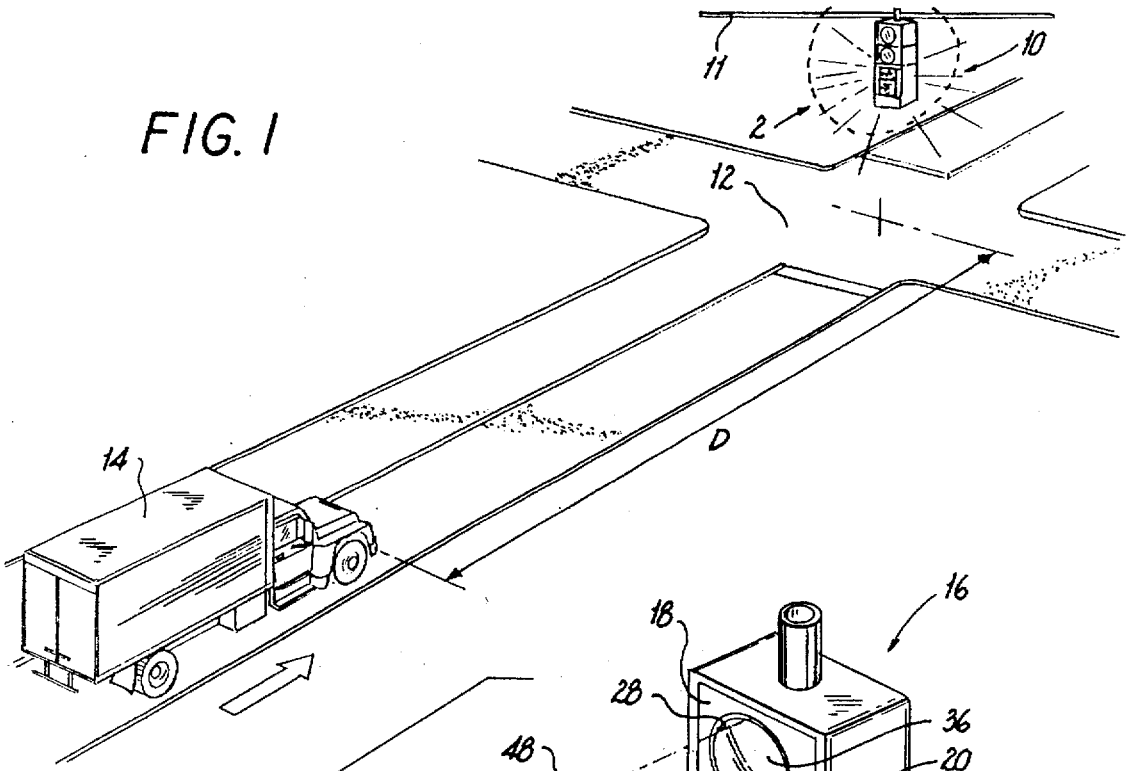
FIG. 1 is a diagrammatic perspective view illustrating the present invention in use.

List of Reference Numerals Utilized in the Drawing

10 time indicating traffic light of the present invention
11 cable
12 intersection
14 approaching vehicle
16 vertically-oriented and rectangular-parallelepiped-shaped housing
18 housing rectangular-shaped front
20 housing front upper portion
22 housing front upper intermediate portion
24 housing front lower intermediate portion
26 housing front lower portion
28 housing front upper portion circular-shaped throughbore
30 housing front upper intermediate portion circular-shaped throughbore
32 housing front lower intermediate portion five adjacent, slightly vertically spaced-apart, horizontally-oriented, and rectangular-shaped throughbores
34 housing front lower intermediate portion pair of parallel, elongated, spaced-apart, vertically-oriented, and rectangular-shaped throughbores
36 circular-shaped "stop" indicator light
38 circular-shaped "caution" indicator light
40 seven rectangular-shaped "go" indicator lights
42 optional vertically-oriented, slender, and rectangular-shaped turn signal plate
44 turn signal plate inner edge
46 turn signal plate inner edge five, adjacent, slightly vertically spaced-apart, and outwardly converging V-shaped grooves
48 substantially semi-cylindrically-shaped "stop" light visor
50 substantially semi-cylindrically-shaped "caution" light visor
52 inverted substantially U-shaped "go" light visor
54 time indicating display
56 time indicating display pair of horizontally-oriented, parallel, vertically spaced-apart, and L-shaped slide tracks
58 time indicating display pair of generally rectangular-shaped digital plates
60 time indicating display light reflective integer
62 time indicating display vertically-oriented, and L-shaped slide track
64 time indicating display vertical track maintaining lock screw

DETAILED DESCRIPTION OF THE PREFERRED EMBODIMENT

Referring now to the figures, and particularly FIG. 1, which is a diagrammatic perspective view illustrating the present invention in use, the time indicating traffic light of the present invention is shown generally at 10 hanging from a cable 11 at an intersection 12 and indicating the signal condition to an approaching vehicle 14.

It is to be understood that the use of the cable 11 to hang the time indicating traffic light 10 is for illustrative purposes only, and that any acceptable means for positioning the time indicating traffic light 10 can be used without departing in any way from the spirit of the present invention.

Figure 2:
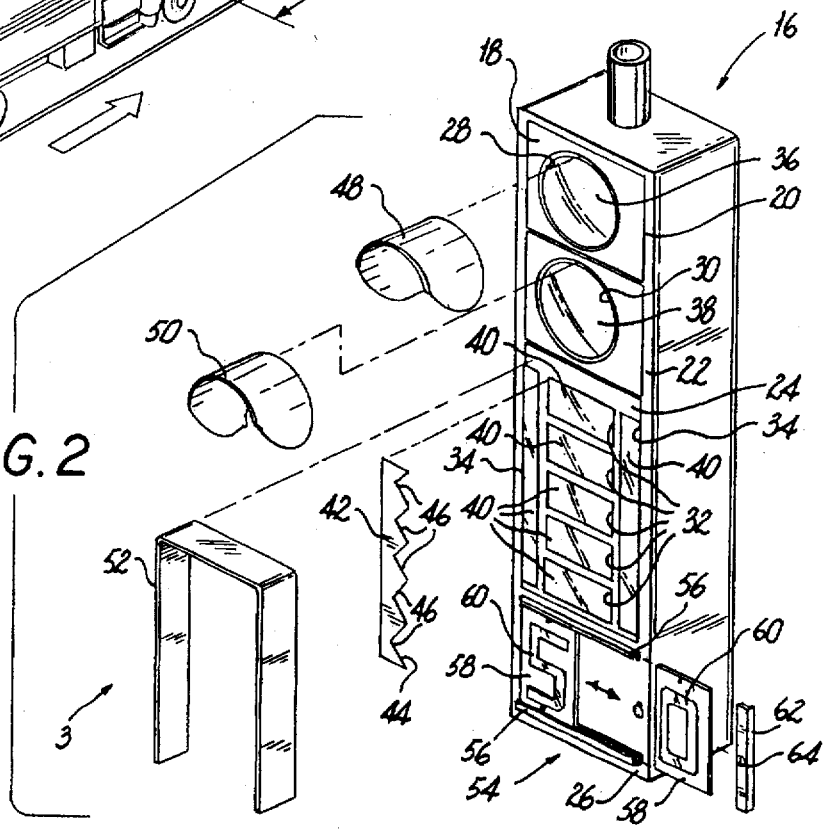
FIG. 2 is an enlarged diagrammatic and partially exploded perspective view of the present invention, as encircled by the dotted area identified by arrow 2 in FIG. 1.
Figure 3:
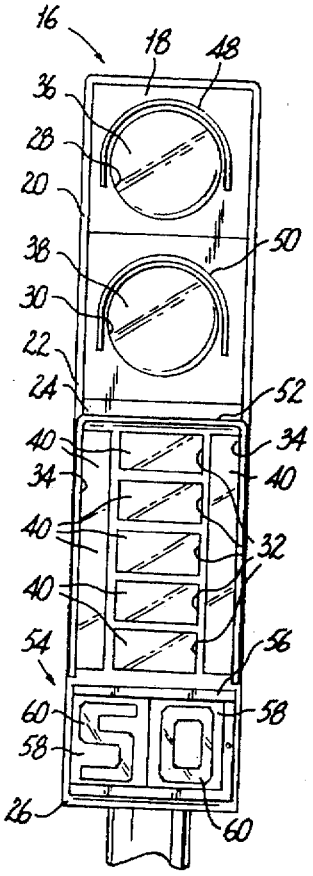
FIG. 3 is a diagrammatic front elevational view of the present invention taken generally in the direction of arrow 3 in FIG. 2.

The configuration of the time indicating traffic signal 10 can best be seen in FIGS. 2 and 3, which are an enlarged diagrammatic and partially exploded perspective view of the present invention, as encircled by the dotted area identified by arrow 2 in FIG. 1 and a diagrammatic front elevational view of the present invention taken generally in the direction of arrow 3 in FIG. 2, respectively, and as such will be discussed with reference thereto.

The time indicating traffic light 10 includes a vertically-oriented and rectangular-parallelepiped-shaped housing 16 with a housing rectangular-shaped front 18. The housing rectangular-shaped front 18 of the vertically-oriented and rectangular-parallelepiped-shaped housing 16 has a housing front upper portion 20, a housing front upper intermediate portion 22 disposed below the housing front upper portion 20 of the housing rectangular-shaped front 18 of the vertically-oriented and rectangular-parallelepiped-shaped housing 16, a housing front lower intermediate portion 24 disposed below the housing front upper intermediate portion 22 of the housing rectangular-shaped front 18 of the vertically-oriented and rectangular-parallelepiped-shaped housing 16, and a housing front lower portion 26 that has an upper boundary and a lower boundary and is disposed below the housing front lower intermediate portion 24 of the housing rectangular-shaped front 18 of the vertically-oriented and rectangular-parallelepiped-shaped housing 16.

The housing front upper portion 20 of the housing rectangular-shaped front 18 of the vertically-oriented and rectangular-parallelepiped-shaped housing 16 has a housing front upper portion circular-shaped throughbore 28 that extends horizontally therethrough.

The housing front upper intermediate portion 22 of the housing rectangular-shaped front 18 of the vertically-oriented and rectangular-parallelepiped-shaped housing 16 has a housing front upper intermediate portion circular-shaped throughbore 30 that extends horizontally therethrough.

The housing front lower intermediate portion 24 of the housing rectangular-shaped front 18 of the vertically-oriented and rectangular-parallelepiped-shaped housing 16 has a housing front lower intermediate portion five adjacent, slightly vertically spaced-apart, horizontally-oriented, and rectangular-shaped throughbores 32 that extend horizontally therethrough and have a combined height.

The housing front lower intermediate portion 24 of the housing rectangular-shaped front 18 of the vertically-oriented and rectangular-parallelepiped-shaped housing 16 further has a housing front lower intermediate portion pair of parallel, elongated, spaced-apart, vertically-oriented, and rectangular-shaped throughbores 34 that extend horizontally therethrough.

One throughbore of the housing front lower intermediate portion pair of parallel, elongated, spaced-apart, vertically-oriented, and rectangular-shaped throughbores 34 in the housing front lower intermediate portion 24 of the housing rectangular-shaped front 18 of the vertically-oriented and rectangular-parallelepiped-shaped housing 16 is disposed parallel to, and slightly to one side of, the housing front lower intermediate portion five adjacent, slightly vertically spaced-apart, horizontally-oriented, and rectangular-shaped throughbores 32 in the housing front lower intermediate portion 24 of the housing rectangular-shaped front 18 of the vertically-oriented and rectangular-parallelepiped-shaped housing 16, and extends the combined height thereof.

Another throughbore of the housing front lower intermediate portion pair of parallel, elongated, spaced-apart, vertically-oriented, and rectangular-shaped throughbores 34 in the housing front lower intermediate portion 24 of the housing rectangular-shaped front 18 of the vertically-oriented and rectangular-parallelepiped-shaped housing 16 is disposed parallel to, and slightly to an opposite side of, the housing front lower intermediate portion five adjacent, slightly vertically spaced-apart horizontally-oriented, and rectangular-shaped throughbores 32 in the housing front lower intermediate portion 24 of the housing rectangular-shaped front 18 of the vertically-oriented and rectangular-parallelepiped-shaped housing 16, and extends the combined height thereof.

The time indicating traffic light 10 further includes a circular-shaped "stop" indicator light 36 that has an upper periphery and is disposed in the housing front upper portion circular-shaped throughbore 28 in the housing front upper portion 20 of the housing rectangular-shaped front 18 of the vertically-oriented and rectangular-parallelepiped-shaped housing 16.

It is to be understood that the circular-shaped "stop" indicator light 36 is preferably red since red is the international signal for "stop," but may be any other accepted color without departing in any way from the spirit of the present invention.

The time indicating traffic light 10 further includes a circular-shaped "caution" indicator light 38 that has an upper periphery and is disposed in the housing front upper intermediate portion circular-shaped throughbore 30 in the housing front upper intermediate portion 22 of the housing rectangular-shaped front 18 of the vertically-oriented and rectangular-parallelepiped-shaped housing 16.

It is to be understood that the circular-shaped "caution" indicator light 38 is preferably amber since amber is the international signal for "caution," but may be any other accepted color without departing in any way from the spirit of the present invention.

The time indicating traffic light 10 further includes seven rectangular-shaped "go" indicator lights 40 that have an uppermost horizontal edge and a pair of outermost vertical edges and which are disposed in the housing front lower intermediate portion five adjacent, slightly vertically spaced-apart, horizontally-oriented, and rectangular-shaped throughbores 32 in the housing front lower intermediate portion 24 of the housing rectangular-shaped front 18 of the vertically-oriented and rectangular-parallelepiped-shaped housing 16 and in the housing front lower intermediate portion pair of parallel, elongated, spaced-apart, vertically-oriented, and rectangular-shaped throughbores 34 in the housing front lower intermediate portion 24 of the housing rectangular-shaped front 18 of the vertically-oriented and rectangular-parallelepiped-shaped housing 16.

It is to be understood that the seven rectangular-shaped "go" indicator lights 40 are preferably green since green is the international signal for "go," but may be any other accepted color without departing in any way from the spirit of the present invention.

The time indicating traffic light 10 further includes an optional vertically-oriented, slender, and rectangular-shaped turn signal plate 42 that has a turn signal plate inner edge 44 with a turn signal plate inner edge five, adjacent, slightly vertically spaced-apart, and outwardly converging V-shaped grooves 46 therealong.

The optional vertically-oriented, slender, and rectangular-shaped turn signal plate 42 is positionable over either of the sides of five lights of the seven rectangular-shaped "go" indicator lights 40 that are disposed in the housing front lower intermediate portion five adjacent, slightly vertically spaced-apart, horizontally-oriented, and rectangular-shaped throughbores 32 in the housing front lower intermediate portion 24 of the housing rectangular-shaped front 18 of the vertically-oriented and rectangular-parallelepiped-shaped housing 16, with each groove of the turn signal plate inner edge five, adjacent, slightly vertically spaced-apart, and outwardly diverging V-shaped grooves 46 in the turn signal plate inner edge 44 of the optional vertically-oriented, slender, and rectangular-shaped turn signal plate 42 being aligned with a respective light of the five lights of the seven rectangular-shaped "go" indicator lights 40 that are disposed in the housing front lower intermediate portion five adjacent, slightly vertically spaced-apart, horizontally-oriented, and rectangular-shaped throughbores 32 in the housing front lower intermediate portion 24 of the housing rectangular-shaped front 18 of the vertically-oriented and rectangular-parallelepiped-shaped housing 16, so that the five lights of the seven rectangular-shaped "go" indicator lights 40 that are disposed in the housing front lower intermediate portion five adjacent, slightly vertically spaced-apart, horizontally-oriented, and rectangular-shaped throughbores 32 in the housing front lower intermediate portion 24 of the housing rectangular-shaped front 18 of the vertically-oriented and rectangular-parallelepiped-shaped housing 16 now have pointed sides and can be used as turn signal indicators, if so desired.

The time indicating traffic light 10 further includes a substantially semi-cylindrically-shaped "stop" light visor 48 that extends outwardly from the upper periphery of the circular-shaped "stop" indicator light 36.

The time indicating traffic light 10 further includes a substantially semi-cylindrically-shaped "caution" light visor 50 that extends outwardly from the upper periphery of the circular-shaped "caution" indicator light 38.

The time indicating traffic light 10 further includes a inverted substantially U-shaped "go" light visor 52 that is disposed over, and extends outwardly from, the uppermost horizontal edge and the pair of outermost vertically edges of the seven rectangular-shaped "go" indicator lights 40.

The time indicating traffic light 10 further includes a time indicating display 54 that is disposed on the housing front lower portion 26 of the housing rectangular-shaped front 18 of the vertically-oriented and rectangular-parallelepiped-shaped housing 16 and provides a visible display of the time of illumination of the seven rectangular-shaped "go" indicator lights 40.

The time indicating display 54 includes a time indicating display pair of horizontally-oriented, parallel, vertically spaced-apart, and L-shaped slide tracks 56. One track of the time indicating display pair of horizontally-oriented, parallel, vertically spaced-apart, and L-shaped slide tracks 56 of the time indicating display 54 is disposed horizontally, and in proximity to, the upper boundary of the housing front lower portion 26 of the housing rectangular-shaped front 18 of the vertically-oriented and rectangular-parallelepiped-shaped housing 16, while another track of the time indicating display pair of horizontally-oriented, parallel, vertically spaced-apart, and L-shaped slide tracks 56 of the time indicating display 54 is disposed horizontally, and in proximity to, the lower boundary of the housing front lower portion 26 of the housing rectangular-shaped front 18 of the vertically-oriented and rectangular-parallelepiped-shaped housing 16.

The time indicating display 54 further includes a time indicating display pair of generally rectangular-shaped digital plates 58 that are slidably and replaceably mounted in the time indicating display pair of horizontally-oriented, parallel, vertically spaced-apart, and L-shaped slide tracks 56 of the time indicating display 54.

Each plate of the time indicating display pair of generally rectangular-shaped digital plates 58 of the time indicating display 54 has disposed thereon a time indicating display light reflective integer 60 that is in the range of "0" to "9", so that by using the time indicating display pair of generally rectangular-shaped digital plates digital plates 58 of the time indicating display 54 with the appropriate time indicating display light reflective integer 60 of the time indicating display 54 disposed thereon, the approaching vehicle 14 is provided with a visible means of knowing how much time the seven rectangular-shaped "go" indicator lights 40 will be illuminated, especially at night.

It is to be understood that the use of "50" for the time indicating display light reflective integers 60 are for illustrative purposes only and that any other integer can be used without departing in any way from the spirit of the present invention.

To maintain the time indicating display pair of generally rectangular-shaped digital plates 58 of the time indicating display 54 in the time indicating display pair of horizontally-oriented, parallel, vertically spaced-apart, and L-shaped slide tracks 56 of the time indicating display 54 and prevent unauthorized manipulation or removal thereof, a pair of corresponding ends of the time indicating display pair of horizontally-oriented, parallel, vertically spaced-apart, and L-shaped slide tracks 56 of the time indicating display 54 are provided with stops so as to prevent movement of the time indicating display pair of generally rectangular-shaped digital plates 58 of the time indicating display 54 therepast, while another pair of corresponding ends of the time indicating display pair of horizontally-oriented, parallel, vertically spaced-apart, and L-shaped slide tracks 56 of the time indicating display 54 have extending therebetween a time indicating display vertically-oriented, and L-shaped slide track 62 that is replaceably maintained to the housing front lower portion 26 of the housing rectangular-shaped front 18 of the vertically-oriented and rectangular-parallelepiped-shaped housing 16 by a time indicating display vertical track maintaining lock screw 64 that passes replaceably through a throughbore therein and into a throughbore in the housing front lower portion 26 of the housing rectangular-shaped front 18 of the vertically-oriented and rectangular-parallelepiped-shaped housing 16.

The method of intentionally manipulating the time indicating display 54 to correspond to the time of illumination of the seven rectangular-shaped "go" indicator lights 40 can best be seen in FIG. 2, which is an enlarged diagrammatic and partially exploded perspective view of the present invention, as encircled by the dotted area identified by arrow 2 in FIG. 1, and as such will be discussed with reference thereto.

STEP 1: Remove the time indicating display vertical track maintaining lock screw 64 of the time indicating display 54 from the throughbore in the housing front lower portion 26 of the housing rectangular-shaped front 18 of the vertically-oriented and rectangular-parallelepiped-shaped housing 16 and from the throughbore in the time indicating display vertically-oriented, and L-shaped slide track 62 of the time indicating display 54.

STEP 2: Remove the time indicating display vertically-oriented, and L-shaped slide track 62 of the time indicating display 54 from the housing front lower portion 26 of the housing rectangular-shaped front 18 of the vertically-oriented and rectangular-parallelepiped-shaped housing 16.

STEP 3: Slide the appropriate plates of the time indicating display pair of generally rectangular-shaped digital plates 58 of the time indicating display 54 out of and/or into the time indicating display pair of horizontally-oriented, parallel, vertically spaced-apart, and L-shaped slide tracks 56 of the time indicating display 54.

STEP 4: Replace the time indicating display vertically-oriented, and L-shaped slide track 62 of the time indicating display 54 onto the housing front lower portion 26 of the housing rectangular-shaped front 18 of the vertically-oriented and rectangular-parallelepiped-shaped housing 16.

STEP 5: Replace the time indicating display vertical track maintaining lock screw 64 of the time indicating display 54 into the throughbore in the time indicating display vertically-oriented, and L-shaped slide track 62 of the time indicating display 54 and into the throughbore in the housing front lower portion 26 of the housing rectangular-shaped front 18 of the vertically-oriented and rectangular-parallelepiped-shaped housing 16.1

The method of operation of the time indicating traffic light 10 can best be seen in FIGS. 4A–4G, and as such will be discussed with reference thereto.

The pair of vertically-oriented lights of the seven rectangular-shaped "go" indicator lights 40 provide a means of determining the time left, when the time indicating display may not be easily seen such as when the approaching vehicle 14 is at a far distance, by providing a visual comparison of the light emanating therefrom with the light emanating from whatever horizontally-oriented lights of the seven rectangular-shaped "go" indicator lights 40 are illuminated.

The pair of vertically-oriented lights of the seven rectangular-shaped "go" indicator lights 40 remain illuminated when at least one light of the horizontally-oriented lights of the seven rectangular-shaped "go" indicator lights 40 is illuminated, while the horizontally-oriented lights of the seven rectangular-shaped "go" indicator lights 40 extinguish progressively upwardly, towards the circular-shaped "caution" indicator light 38, at a predetermined rate determined by a timer.

For example, if the seven rectangular-shaped "go" indicator lights 40 are to be illuminated for "50" seconds, as indicated on the time indicating display pair of generally rectangular-shaped digital plates digital plates 58 of the time indicating display 54, each successive light of the horizontally-oriented lights of the seven rectangular-shaped "go" indicator lights 40 will be progressively extinguished every 10 seconds, so that by observing the number of the horizontally-oriented lights of the seven rectangular-shaped "go" indicator lights 40 that remain illuminated and the time indicated on the time indicating display pair of generally rectangular-shaped digital plates digital plates 58 of the time indicating display 54, the approaching vehicle 14 can determine the time remaining before the circular-shaped "caution" indicator light 38 is illuminated.

Figure 4A:
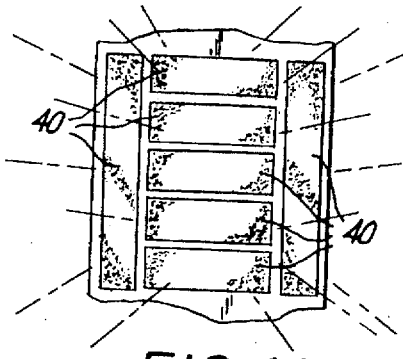
FIG. 4A is an enlarged diagrammatic front elevational view, with parts broken away, and with only all seven green lights illuminated.

As shown in FIG. 4A, which is an enlarged diagrammatic front elevational view, with parts broken away, and with only all seven green lights illuminated, all of the seven rectangular-shaped "go" indicator lights 40 are illuminated indicating that the approaching vehicle 14 has the time indicated on the time indicating display 54 before the circular-shaped "caution" indicator light 38 is illuminated.

Figure 4D:
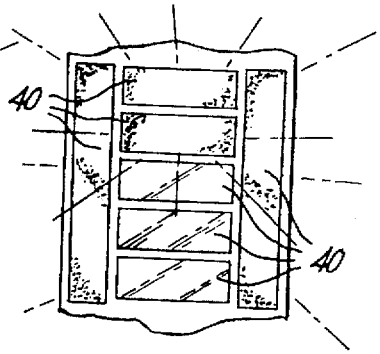
FIG. 4D is an enlarged diagrammatic front elevational view, with parts broken away, and with only four green lights illuminated.
Figure 4B:
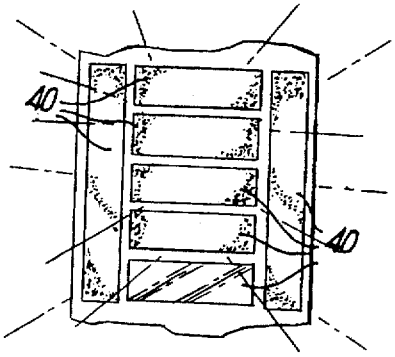
FIG. 4B is an enlarged diagrammatic front elevational view, with parts broken away, and with only six green lights illuminated.

As shown in FIG. 4B, which is an enlarged diagrammatic front elevational view, with parts broken away, and with only six green lights illuminated, a predetermined time has elapsed as controlled by the timer and a lowermost horizontally-oriented light of the seven rectangular-shaped "go" indicator lights 40 has been extinguished indicating that the approaching vehicle 14 now has only 4/5 of the time indicated on the time indicating display 54 before the circular-shaped "caution" indicator light 38 is illuminated.

Figure 4E:
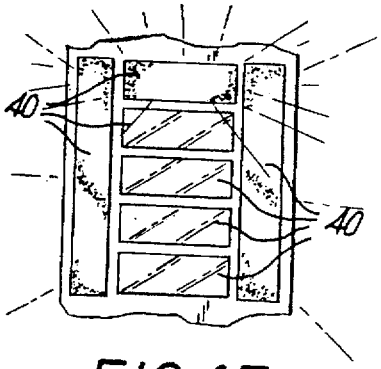
FIG. 4E is an enlarged diagrammatic front elevational view, with parts broken away, and with only three green lights illuminated.
Figure 4G:
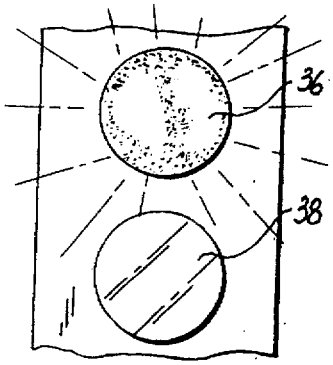
FIG. 4G is an enlarged diagrammatic front elevational view, with parts broken away, and with the amber light off and only the red light illuminated.
Figure 4C:
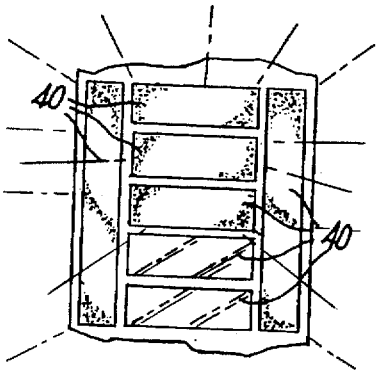
FIG. 4C is an enlarged diagrammatic front elevational view, with parts broken away, and with only five green lights illuminated.

As shown in FIG. 4C, which an enlarged diagrammatic front elevational view, with parts broken away, and with only five green lights illuminated, the predetermined time has again elapsed as controlled by the timer, and a next higher horizontally-oriented light of the seven rectangular-shaped "go" indicator lights 40 has been extinguished indicating that the approaching vehicle 14 now has only 3/5 of the time indicated on the time indicating display 54 before the circular-shaped "caution" indicator light 38 is illuminated.

As shown in FIG. 4D, which is an enlarged diagrammatic front elevational view, with parts broken away, and with only four green lights illuminated, the predetermined time has again elapsed as controlled by the timer and a next higher horizontally-oriented light of the seven rectangular-shaped "go" indicator lights 40 has been extinguished indicating that the approaching vehicle 14 now has only 2/5 of the time indicated on the time indicating display 54 before the circular-shaped "caution" indicator light 38 is illuminated.

As shown in FIG. 4E, which is an enlarged diagrammatic front elevational view, with parts broken away, and with only three green lights illuminated, the predetermined time has again elapsed as controlled by the timer and a next higher horizontally-oriented light of the seven rectangular-shaped "go" indicator lights 40 has been extinguished indicating that the approaching vehicle 14 now has only 1/5 of the time indicated on the time indicating display 54 before the circular-shaped "caution" indicator light 38 is illuminated.

Figure 4F:
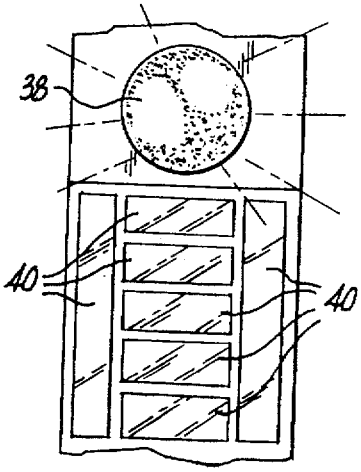
FIG. 4F is an enlarged diagrammatic front elevational view, with parts broken away, and with all the green lights off and only the amber light illuminated.

As shown in FIG. 4F, which is an enlarged diagrammatic front elevational view, with parts broken away, and with all the green lights off and only the amber light illuminated, the predetermined time has again elapsed as controlled by the timer and the remaining horizontally-oriented light of the seven rectangular-shaped "go" indicator lights 40 has been extinguished which causes the pair of vertically oriented lights of the seven rectangular-shaped "go" indicator lights 40 to be also extinguished since the pair of vertically-oriented lights of the seven rectangular-shaped "go" indicator lights 40 remain illuminated only when at least one light of the horizontally-oriented lights of the seven rectangular-shaped "go" indicator lights 40 remains illuminated, indicating that the approaching vehicle 14 now has none of the time indicated on the time indicating display 54 before the circular-shaped "caution" indicator light 38 is illuminated, and the circular-shaped "caution" indicator light 38 is illuminated.

As shown in FIG. 4G, which is an enlarged diagrammatic front elevational view, with parts broken away, and with the amber light off and only the red light illuminated, the predetermined time has again elapsed as controlled by the timer and the circular-shaped "caution" indicator light 38 is extinguished and the circular-shaped "stop" indicator light 36 is illuminated.

It will be understood that each of the elements described above, or two or more together, may also find a useful application in other types of constructions differing from the types described above.

While the invention has been illustrated and described as embodied in a time indicating traffic light, it is not limited to the details shown, since it will be understood that various omissions, modifications, substitutions, and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A time indicating traffic light, comprising:

a) a vertically-oriented and rectangular-parallelepiped-shaped housing;

b) a circular-shaped "stop" indicator light disposed in said vertically-oriented and rectangular-parallelepiped-shaped housing;

c) a circular-shaped "caution" indicator light disposed in said vertically-oriented and rectangular-parallelepiped-shaped housing below said circular-shaped "stop" indicator light;

d) seven rectangular-shaped "go" indicator lights disposed in said vertically-oriented and rectangular-parallelepiped-shaped housing below said circular-shaped "caution" indicator light and having a time of illumination, a pair of parallel, elongated, spaced-apart, vertically-oriented, and rectangular-shaped "go" indicator lights, and five adjacent, slightly vertically spaced-apart, horizontally-oriented, and rectangular-shaped "go" lights disposed between said pair of parallel, elongated, spaced-apart, vertically-oriented, and rectangular-shaped "go" indicator lights of said seven rectangular-shaped "go" indicator lights; said five adjacent, slightly vertically spaced-apart, horizontally-oriented, and rectangular-shaped "go" lights of said seven rectangular-shaped "go" indicator lights extinguishing progressively upwardly towards said circular-shaped "caution" indicator light at a predetermined rate determined by a timer while said pair of parallel, elongated, spaced-apart, vertically-oriented, and rectangular-shaped "go" indicator lights of said seven rectangular-shaped "go" indicator lights remaining illuminated when at least one light of said five adjacent, slightly vertically spaced-apart, horizontally-oriented, and rectangular-shaped "go" lights of said seven rectangular-shaped "go" indicator lights is illuminated; and e) a time indicating display disposed on said vertically-oriented and rectangular-parallelepiped-shaped housing below said seven rectangular-shaped "go" indicator lights and providing a visible display of said time of illumination of said seven rectangular-shaped "go" indicator lights, so that an approaching vehicle can determine when said circular-shaped "caution" indicator light will be illuminated by dividing said time of illumination on said time indicating display by number of lights of said five adjacent, slightly vertically spaced-apart, horizontally-oriented, and rectangular-shaped "go" lights of said seven rectangular-shaped "go" indicator lights extinguished and thereby prevent sudden acceleration followed by a sudden stop while said pair of parallel, elongated, spaced-apart, vertically-oriented, and rectangular-shaped "go" indicator lights of said seven rectangular-shaped "go" indicator lights provide a means of determining when said circular-shaped "caution" indicator light will be illuminated when said time indicating display may not be easily seen such as when the approaching vehicle is at a far distance by providing a visual comparison of light emanating therefrom with light emanating from whatever lights of said five adjacent, slightly vertically spaced-apart, horizontally-oriented, and rectangular-shaped "go" lights of said seven rectangular-shaped "go" indicator lights are illuminated.

2. The light as defined in claim 1, wherein said circular-shaped "stop" indicator light is red since red is the international signal for "stop."

3. The light as defined in claim 1, wherein said circular-shaped "caution" indicator light is amber since amber is the international signal for "caution."

4. The light as defined in claim 1, wherein said seven rectangular-shaped "go" indicator lights are green since green is the international signal for "go."

5. The light as defined in claim 1; further comprising a vertically-oriented, slender, and rectangular-shaped turn signal plate having an inner longitudinal edge with five, adjacent, slightly vertically spaced-apart, and outwardly converging V-shaped grooves therealong and being positionable over either side of said five adjacent, slightly vertically spaced-apart, horizontally-oriented, and rectangular-shaped "go" lights of said seven rectangular-shaped "go" indicator lights with each groove of said five, adjacent, slightly vertically spaced-apart, and outwardly converging V-shaped grooves in said inner longitudinal edge of said vertically-oriented, slender, and rectangular-shaped turn signal plate being aligned with a respective light of said five adjacent, slightly vertically spaced-apart, horizontally-oriented, and rectangular-shaped "go" lights of said seven rectangular-shaped "go" indicator lights, so that said five adjacent, slightly vertically spaced-apart, horizontally-oriented, and rectangular-shaped "go" lights of said seven rectangular-shaped "go" indicator lights have a respective set of pointed sides and can be used as turn signal indicators, if so desired.

6. The light as defined in claim 1, wherein said vertically-oriented and rectangular-parallelepiped-shaped housing has a rectangular-shaped front with an upper portion, an upper intermediate portion disposed below said upper portion of said rectangular-shaped front of said vertically-oriented and rectangular-parallelepiped-shaped housing, a lower intermediate portion disposed below said upper intermediate portion of said rectangular-shaped front of said vertically-oriented and rectangular-parallelepiped-shaped housing, and a lower portion that has an upper boundary and a lower boundary and is disposed below said lower intermediate portion of said rectangular-shaped front of said vertically-oriented and rectangular-parallelepiped-shaped housing.

7. The light as defined in claim 6, wherein said upper portion of said rectangular-shaped front of said vertically-oriented and rectangular-parallelepiped-shaped housing has a circular-shaped throughbore that extends horizontally therethrough.

8. The light as defined in claim 7, wherein said circular-shaped "stop" indicator light has an upper periphery and occupies said circular-shaped throughbore in said upper portion of said rectangular-shaped front of said vertically-oriented and rectangular-parallelepiped-shaped housing.

9. The light as defined in claim 8; further comprising a substantially semi-cylindrically-shaped "stop" light visor extending outwardly from said upper periphery of said circular-shaped "stop" indicator light.

10. The light as defined in claim 6, wherein said upper intermediate portion of said rectangular-shaped front of said vertically-oriented and rectangular-parallelepiped-shaped housing has a circular-shaped throughbore that extends horizontally therethrough.

11. The light as defined in claim 10, wherein said circular-shaped "caution" indicator light has an upper periphery and occupies said circular-shaped throughbore in said upper intermediate portion of said rectangular-shaped front of said vertically-oriented and rectangular-parallelepiped-shaped housing.

12. The light as defined in claim 11; further comprising a substantially semi-cylindrically-shaped "caution" light visor extending outwardly from said upper periphery of said circular-shaped "caution" indicator light.

13. The light as defined in claim 6, wherein said lower intermediate portion of said rectangular-shaped front of said vertically-oriented and rectangular-parallelepiped-shaped housing has five adjacent, slightly vertically spaced-apart, horizontally-oriented, and rectangular-shaped throughbores that extend horizontally therethrough and have a combined height.

14. The light as defined in claim 13, wherein said lower intermediate portion of said rectangular-shaped front of said vertically-oriented and rectangular-parallelepiped-shaped housing further has a pair of parallel, elongated, spaced-apart, vertically-oriented, and rectangular-shaped throughbores that extend horizontally therethrough.

15. The light as defined in claim 14, wherein one throughbore of said pair of parallel, elongated, spaced-apart, vertically-oriented, and rectangular-shaped throughbores in said lower intermediate portion of said rectangular-shaped front of said vertically-oriented and rectangular-parallelepiped-shaped housing is disposed parallel to, and slightly to one side of, said five adjacent, slightly vertically spaced-apart, horizontally-oriented, and rectangular-shaped throughbores in said lower intermediate portion of said rectangular-shaped front of said vertically-oriented and rectangular-parallelepiped-shaped housing and extends said combined height thereof.

16. The light as defined in claim 15, wherein another throughbore of said pair of parallel, elongated, spaced-apart, vertically-oriented, and rectangular-shaped throughbores in said lower intermediate portion of said rectangular-shaped front of said vertically-oriented and rectangular-parallelepiped-shaped housing is disposed parallel to, and slightly to an opposite side of, said five adjacent, slightly vertically spaced-apart horizontally-oriented, and rectangular-shaped throughbores in said lower intermediate portion of said rectangular-shaped front of said vertically-oriented and rectangular-parallelepiped-shaped housing and extends said combined height thereof.

17. The light as defined in claim 16, wherein said seven rectangular-shaped "go" indicator lights have an uppermost horizontal edge and a pair of outermost vertical edges; each light of said five adjacent, slightly vertically spaced-apart, horizontally-oriented, and rectangular-shaped "go" lights of said seven rectangular-shaped "go" indicator lights occupies a respective throughbore of said five adjacent, slightly vertically spaced-apart, horizontally-oriented, and rectangular-shaped throughbores in said lower intermediate portion of said rectangular-shaped front of said vertically-oriented and rectangular-parallelepiped-shaped housing; each light of said pair of parallel, elongated, spaced-apart, vertically-oriented, and rectangular-shaped "go" indicator lights of said seven rectangular-shaped "go" indicator lights occupies a respective throughbore of said pair of parallel, elongated, spaced-apart, vertically-oriented, and rectangular-shaped throughbores in said lower intermediate portion of said rectangular-shaped front of said vertically-oriented and rectangular-parallelepiped-shaped housing.

18. The light as defined in claim 17; further comprising a inverted substantially U-shaped "go" light visor extending outwardly from said uppermost horizontal edge and said pair of outermost vertical edges of said seven rectangular-shaped "go" indicator lights.

19. The light as defined in claim 6, wherein said time indicating display is disposed on said lower portion of said rectangular-shaped front of said vertically-oriented and rectangular-parallelepiped-shaped housing and includes a pair of horizontally-oriented, parallel, vertically spaced-apart, and L-shaped slide tracks; one track of said pair of horizontally-oriented, parallel, vertically spaced-apart, and L-shaped slide tracks of said time indicating display is disposed horizontally, and in proximity to, said upper boundary of said lower portion of said rectangular-shaped front of said vertically-oriented and rectangular-parallelepiped-shaped housing; another track of said pair of horizontally-oriented, parallel, vertically spaced-apart, and L-shaped slide tracks of said time indicating display is disposed horizontally, and in proximity to, said lower boundary of said lower portion of said rectangular-shaped front of said vertically-oriented and rectangular-parallelepiped-shaped housing.

20. The light as defined in claim 19, wherein said time indicating display further includes a pair of generally rectangular-shaped digital plates that are slidably and replaceably mounted in said pair of horizontally-oriented, parallel, vertically spaced-apart, and L-shaped slide tracks of said time indicating display.

21. The light as defined in claim 20, wherein each plate of said pair of generally rectangular-shaped digital plates of said time indicating display has disposed thereon a light reflective integer in a range of "0" to "9", so that by using said pair of generally rectangular-shaped digital plates of said time indicating display with appropriate said light reflective integers of said time indicating display disposed thereon, visible means is provided to the approaching vehicle of how much time all of said seven rectangular-shaped "go" indicator lights will be illuminated.

22. The light as defined in claim 21, wherein said pair of horizontally-oriented, parallel, vertically spaced-apart, and L-shaped slide tracks of said time indicating display has a pair of corresponding ends with stops, so that said pair of generally rectangular-shaped digital plates of said time indicating display are prevented from unintentionally sliding out of said pair of corresponding ends of said pair of horizontally-oriented, parallel, vertically spaced-apart, and L-shaped slide tracks of said time indicating display.

23. The light as defined in claim 22, wherein said time indicating display further includes a vertically-oriented, and L-shaped slide track that extends between another pair of corresponding ends of said pair of horizontally-oriented, parallel, vertically spaced-apart, and L-shaped slide tracks of said time indicating display and is replaceably maintained to said lower portion of said rectangular-shaped front of said vertically-oriented and rectangular-parallelepiped-shaped housing by a lock screw that passes replaceably through a throughbore therein and into a throughbore in said lower portion of said rectangular-shaped front of said vertically-oriented and rectangular-parallelepiped-shaped housing, so that said pair of generally rectangular-shaped digital plates of said time indicating display are prevented from unintentionally sliding out of said another pair of corresponding ends of said pair of horizontally-oriented, parallel, vertically spaced-apart, and L-shaped slide tracks of said time indicating display.

24. A method of utilizing a time indicating traffic light to alert an approaching vehicle when a circular-shaped "caution" indicator light will be illuminated, comprising the steps of:

a) extinguishing a circular-shaped "stop" indicator light occupying a circular-shaped throughbore in an upper portion of a horizontally-shaped front of a rectangular-parallelepiped-shaped housing of said time indicating traffic light;

b) extinguishing said circular-shaped "caution" indicator light occupying a circular-shaped throughbore in an upper intermediate portion of said horizontally-shaped front of said rectangular-parallelepiped-shaped housing which is below said upper portion of said horizontally-shaped front of said rectangular-parallelepiped-shaped housing;

c) illuminating five adjacent, slightly vertically spaced-apart, horizontally-oriented, and rectangular-shaped "go" lights of seven rectangular-shaped "go" indicator lights of said time indicating traffic signal that have a combined height and wherein each of which occupies a respective throughbore of five adjacent, slightly vertically spaced-apart, horizontally-oriented, and rectangular-shaped throughbores in a lower intermediate portion of said horizontally-shaped front of said rectangular-parallelepiped-shaped housing which is below said upper intermediate portion of said horizontally-shaped front of said rectangular-parallelepiped-shaped housing;

d) illuminating simultaneously a pair of parallel, elongated, spaced-apart, vertically-oriented, and rectangular-shaped "go" indicator lights of said seven rectangular-shaped "go" indicator lights and wherein each of which occupies a respective throughbore of a pair of elongated, spaced-apart, vertically-oriented, and rectangular-shaped throughbores that are spaced slightly from each side of, and extend said combined height of, said five adjacent, slightly vertically spaced-apart, horizontally-oriented, and rectangular-shaped "go" lights of said seven rectangular-shaped "go" indicator lights;

e) visually inspecting by the approaching vehicle a time indicating display device disposed on a lower portion of said horizontally-shaped front of said rectangular-parallelepiped-shaped housing which is below said lower intermediate portion of said horizontally-shaped front of said rectangular-parallelepiped-shaped housing and which provides a visible display of time of illumination of all of said seven rectangular-shaped "go" indicator lights;

f) extinguishing a lowermost light of said five adjacent, slightly vertically spaced-apart, horizontally-oriented, and rectangular-shaped "go" lights of said seven rectangular-shaped "go" indicator lights after a predetermined time determined by a timer has elapsed;

g) indicating to the approaching vehicle that only 4/5 of said time of illumination of all of said seven rectangular-shaped "go" indicator lights indicated on said time indicating display remains before said circular-shaped "caution" indicator light is illuminated;

h) extinguishing a next higher light of said five adjacent, slightly vertically spaced-apart, horizontally-oriented, and rectangular-shaped "go" lights of said seven rectangular-shaped "go" indicator lights after said predetermined time determined by said timer has elapsed;

i) indicating to the approaching vehicle that only 3/5 of said time of illumination of all of said seven rectangular-shaped "go" indicator lights indicated on said time indicating display remains before said circular-shaped "caution" indicator light is illuminated;

j) extinguishing a next higher light of said five adjacent, slightly vertically spaced-apart, horizontally-oriented, and rectangular-shaped "go" lights of said seven rectangular-shaped "go" indicator lights after said predetermined time determined by said timer has elapsed;

k) indicating to the approaching vehicle that only 2/5 of said time of illumination of all of said seven rectangular-shaped "go" indicator lights indicated on said time indicating display remains before said circular -shaped "caution" indicator light is illuminated;

l) extinguishing a next higher light of said five adjacent, slightly vertically spaced-apart, horizontally-oriented, and rectangular-shaped "go" lights of said seven rectangular-shaped "go" indicator lights after said predetermined time determined by said timer has elapsed;

m) indicating to the approaching vehicle that only 1/5 of said time of illumination of all of said seven rectangular-shaped "go" indicator lights indicated on said time indicating display remains before said circular-shaped "caution" indicator light is illuminated;

n) extinguishing a highest light of said five adjacent, slightly vertically spaced-apart, horizontally-oriented, and rectangular-shaped "go" lights of said seven rectangular-shaped "go" indicator lights after said predetermined time determined by said timer has elapsed;

o) extinguishing simultaneously said pair of parallel, elongated, spaced-apart, vertically-oriented, and rectangular-shaped "go" indicator lights of said seven rectangular-shaped "go" indicator lights; and p) indicating to the approaching vehicle that no time remains before said circular-shaped "caution" indicator light is illuminated, so that the approaching vehicle is alerted that said circular-shaped "caution" indicator light will be illuminated.

25. A method of alerting an approaching vehicle when it is safe to enter an intersection, comprising the steps of visually inspecting a time indicating traffic light which comprises:

a) a vertically-oriented and rectangular-parallelepiped-shaped housing;

b) a circular-shaped "stop" indicator light disposed in said vertically-oriented and rectangular-parallelepiped-shaped housing;

c) a circular-shaped "caution" indicator light disposed in said vertically-oriented and rectangular-parallelepiped-shaped housing below said circular-shaped "stop" indicator light;

d) seven rectangular-shaped "go" indicator lights disposed in said vertically-oriented and rectangular-parallelepiped-shaped housing below said circular-shaped "caution" indicator light and having a time of illumination, a pair of parallel, elongated, spaced-apart, vertically-oriented, and rectangular-shaped "go" indicator lights, and five adjacent, slightly vertically spaced-apart, horizontally-oriented, and rectangular-shaped "go" lights disposed between said pair of parallel, elongated, spaced-apart, vertically-oriented, and rectangular-shaped "go" indicator lights of said seven rectangular-shaped "go" indicator lights; said five adjacent, slightly vertically spaced-apart, horizontally-oriented, and rectangular-shaped "go" lights of said seven rectangular-shaped "go" indicator lights extinguishing progressively upwardly towards said circular-shaped "caution" indicator light at a predetermined rate determined by a timer while said pair of parallel, elongated, spaced-apart, vertically-oriented, and rectangular-shaped "go" indicator lights of said seven rectangular-shaped "go" indicator lights remaining illuminated when at least one light of said five adjacent, slightly vertically spaced-apart, horizontally-oriented, and rectangular-shaped "go" lights of said seven rectangular-shaped "go" indicator lights is illuminated; and e) a time indicating display disposed on said vertically-oriented and rectangular-parallelepiped-shaped housing below said seven rectangular-shaped "go" indicator lights and providing a visible display of said time of illumination of said seven rectangular-shaped "go" indicator lights, so that an approaching vehicle can determine when said circular-shaped "caution" indicator light will be illuminated by dividing said time of illumination on said time indicating display by number of lights of said five adjacent, slightly vertically spaced-apart, horizontally-oriented, and rectangular-shaped "go" lights of said seven rectangular-shaped "go" indicator lights extinguished and thereby prevent sudden acceleration followed by a sudden stop while said pair of parallel, elongated, spaced-apart, vertically-oriented, and rectangular-shaped "go" indicator lights of said seven rectangular-shaped "go" indicator lights provide a means of determining when said circular-shaped "caution" indicator light will be illuminated when said time indicating display may not be easily seen such as when the approaching vehicle is at a far distance by providing a visual comparison of light emanating therefrom with light emanating from whatever lights of said five adjacent, slightly vertically spaced-apart, horizontally-oriented, and rectangular-shaped "go" lights of said seven rectangular-shaped "go" indicator lights are illuminated.

* * * * *